US011333459B2

(12) United States Patent
Hipp

(10) Patent No.: US 11,333,459 B2
(45) Date of Patent: May 17, 2022

(54) ADJUSTABLE TUNING DEVICE

(71) Applicant: Aaron Hipp, Orient, OH (US)

(72) Inventor: Aaron Hipp, Orient, OH (US)

( * ) Notice: Subject to any disclaimer, the term of this patent is extended or adjusted under 35 U.S.C. 154(b) by 0 days.

(21) Appl. No.: 17/494,420

(22) Filed: Oct. 5, 2021

(65) Prior Publication Data

US 2022/0026169 A1 Jan. 27, 2022

Related U.S. Application Data

(63) Continuation of application No. 17/307,035, filed on May 4, 2021.

(60) Provisional application No. 63/033,337, filed on Jun. 2, 2020.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/325; F41A 21/40; F41A 21/42
See application file for complete search history.

(56) References Cited

U.S. PATENT DOCUMENTS 2,662,326 A * 12/1953 Baden ..... F41A 21/42 42/79
2,676,429 A * 4/1954 Gotterson ..... F41A 21/40 42/79
2,779,119 A * 1/1957 Fawcett ..... F41A 21/42 42/79
3,029,540 A * 4/1962 Pachmayr ..... F41A 21/42 42/79
3,161,979 A * 12/1964 Lowe ..... F41A 21/42 42/79
5,020,416 A * 6/1991 Tripp ..... F41A 21/38 89/14.3
5,698,810 A * 12/1997 Rose ..... F41C 27/22 89/14.3
5,814,757 A * 9/1998 Buss ..... F41A 21/36 89/14.3
6,276,251 B1 * 8/2001 Downing ..... F41A 21/36 89/14.3

(Continued)

FOREIGN PATENT DOCUMENTS

WO WO-2008141736 A1 * 11/2008 ..... F41A 21/325

*Primary Examiner* — Joshua T Semick
(74) *Attorney, Agent, or Firm* — Eric B. Fugett; Mark A. Pitchford; Pitchford Fugett, PLLC

(57) ABSTRACT

An adjustable tuning device includes an externally threaded mounting member having a base defining an aperture and a tuning weight having internal threads configured to mate with the externally threaded mounting member. The aperture can be configured to receive a forward portion of a gun such that a threaded protrusion extends forward of the base. The mounting member can have a rear surface configured to abut a forward-facing shoulder of the gun. The tuning weight is rotatable about the mounting member to move in a range of axial positions with respect to the mounting member and a barrel axis. The mounting member can have a skirt extending from the base. The mounting member can have an external diameter at an externally threaded portion, and the tuning weight can have a rear portion with an internal diameter less than the external diameter of the mounting member.

18 Claims, 5 Drawing Sheets

(56) References Cited

U.S. PATENT DOCUMENTS

| | | | | |
|---|---|---|---|---|
| 6,604,445 | B2 * | 8/2003 | Sevastian | F41A 21/36 42/1.06 |
| 8,714,300 | B2 * | 5/2014 | Johansen | F41A 21/325 181/223 |
| 9,080,829 | B1 * | 7/2015 | Cellini | F41A 21/34 |
| 9,134,084 | B1 * | 9/2015 | Harrison | F41A 21/36 |
| 9,182,187 | B1 * | 11/2015 | Griffith | F41A 21/325 |
| 9,709,355 | B2 * | 7/2017 | Joplin | F41A 21/36 |
| 10,024,618 | B1 * | 7/2018 | Moore | F41A 21/36 |
| 10,184,745 | B1 * | 1/2019 | Fulton | F41A 21/30 |
| 10,234,229 | B2 * | 3/2019 | Lessard | F41A 21/325 |
| 10,281,228 | B1 * | 5/2019 | Marfione | F41A 21/30 |
| 10,605,558 | B1 * | 3/2020 | Marfione | F41A 21/30 |
| 10,612,878 | B1 * | 4/2020 | Salvador | F41A 21/325 |
| 10,969,187 | B2 * | 4/2021 | DeJessa | F41A 21/325 |
| 11,125,529 | B2 * | 9/2021 | Yoon | F41A 21/32 |
| 2019/0353466 | A1 * | 11/2019 | Bradley | F41H 7/042 |

* cited by examiner

ADJUSTABLE TUNING DEVICE

CROSS-REFERENCES TO RELATED APPLICATIONS

This nonprovisional patent application is a Continuation of U.S. patent application Ser. No. 17/307,035, filed May 5, 2021 and titled "ADJUSTABLE TUNING DEVICE," which claims priority to U.S. Provisional Patent Application No. 63/033,337 filed on Jun. 2, 2020 and titled "Adaptive Tuning System (ATS)," the entire disclosures of each of which are hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

FIELD OF THE INVENTION

The present invention relates to guns and firearms, and more particularly to an adjustable tuning device that enables the use of a user-selected muzzle device in combination with the adjustable tuning device. It should be appreciated that the present invention can be used with air rifles and other "projectile launching devices," and that the terms "gun" and "firearm" are used in the description and claims broadly to indicate any such devices, and are not limited to the narrow regulatory or technical definition of either guns or firearms. A "projectile launching device" can be any device utilizing a force to accelerate an object into the environment, which is subsequently allowed to move solely under the influence of gravity and air resistance.

BACKGROUND AND SUMMARY OF THE INVENTION

Barrel tuners enable a user to improve the accuracy of a host gun or firearm by adding an adjustable weight to the muzzle of the barrel to manage barrel vibration during firearm discharge. The barrel tuner can be adjusted to not only compensate for the unique characteristics of the host weapon, but also to compensate for variables associated with the ammunition, propellants, fire control, and barrels used to ensure consistent performance.

Although many prior art barrel tuners exist, they have several disadvantages. First, many require a gunsmith to modify the host weapon's barrel by adding contouring and/or additional threads behind the existing muzzle threads to accommodate the barrel tuner. Second, many combine a proprietary muzzle brake combined with the barrel tuner and do not allow the user to use a user-selected muzzle device such as a muzzle brake, suppressor, or thread protector with the barrel tuner. Third, even those prior art barrel tuners that use only the existing muzzle threads do not support the use of a user-selectable muzzle device that shares the existing muzzle threads.

Therefore, a need exists for a new and improved adjustable tuning device that enables the use of a user-selected muzzle device in combination with the adjustable tuning device. In this regard, the various embodiments of the present invention substantially fulfill at least some or all of these needs. In this respect, the adjustable tuning device according to the present invention substantially departs from the conventional concepts and designs of the prior art, and in doing so provides an apparatus primarily developed for the purpose of enabling the use of a user-selected muzzle device in combination with the adjustable tuning device.

The present invention provides an improved adjustable tuning device, and overcomes the above-mentioned disadvantages and drawbacks of the prior art. As such, the general purpose of the present invention, which will be described subsequently in greater detail, is to provide an improved adjustable tuning device that has all the advantages of the prior art mentioned above.

To attain this, an embodiment of the present invention comprises a mounting member having a base defining an aperture configured to closely receive a limited rear portion of the muzzle portion such that a forward portion of the muzzle portion extends forward of the base, the mounting member having a rear surface configured to abut the forward-facing shoulder of a barrel, the mounting member being externally threaded, and a tuning weight having internal threads configured to mate with the externally threaded mounting member and operable to move in a range of axial positions with respect to the mounting member. The mounting member may have a skirt extending rearwardly of the base. The tuning weight may taper to a reduced diameter at a rear end. The mounting member may have an external diameter at an externally threaded portion, and the tuning weight may have a rear portion having an internal diameter less than the external diameter of the mounting member. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE SEVERAL VIEWS OF THE DRAWINGS

The same reference numerals refer to the same parts throughout the various figures.

DETAILED DESCRIPTION

Figure 1:
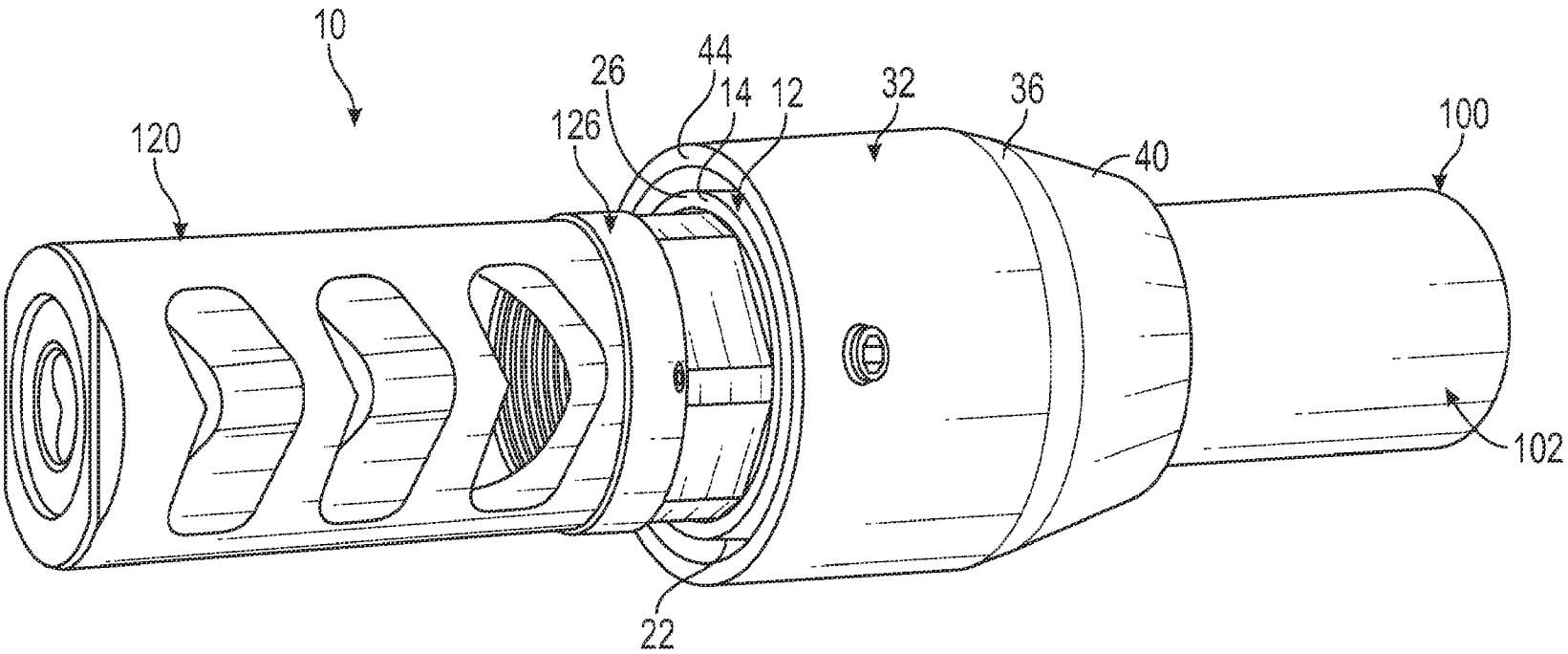
FIG. 1 is an isometric view of an embodiment of an adjustable tuning device constructed in accordance with the principles of the present invention in use with a muzzle brake attached to a barrel in the forward condition.
Figure 2:
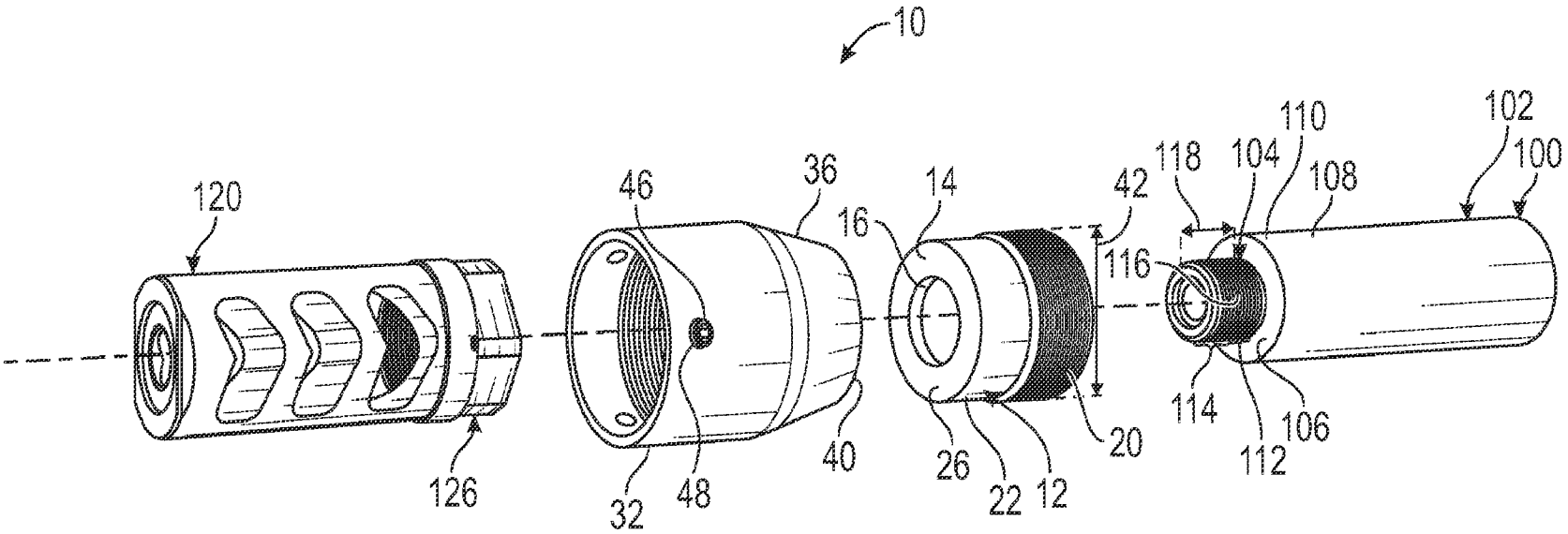
FIG. 2 is an exploded view of the adjustable tuning device of FIG. 1 detached from the barrel.

An embodiment of the adjustable tuning device of the present invention is shown and generally designated by the reference numeral 10.

Figure 4:
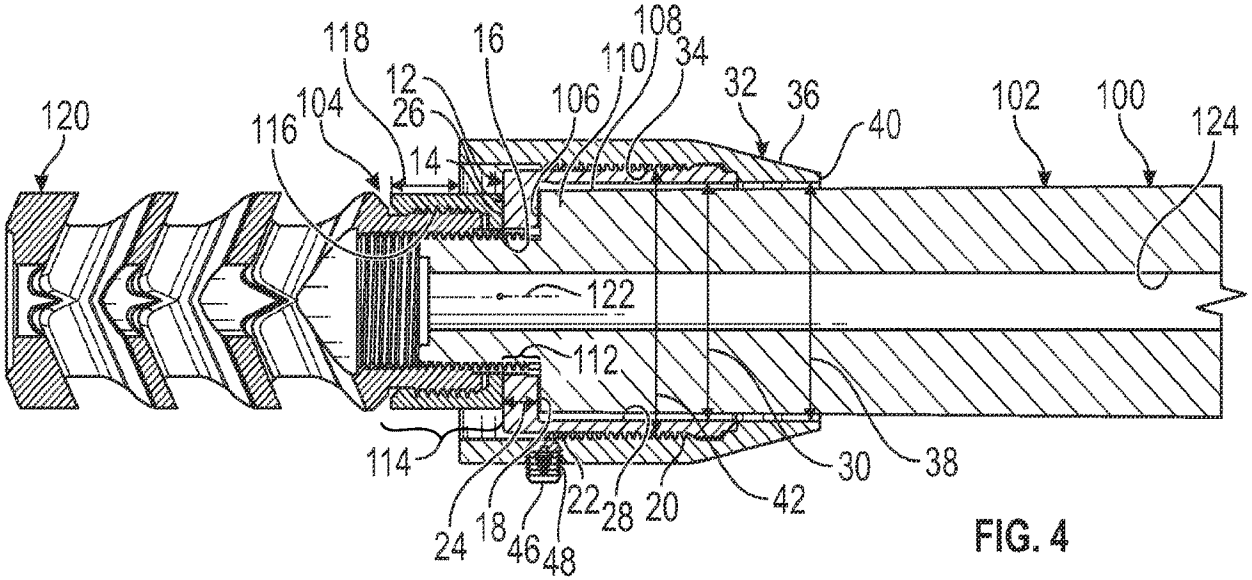
FIG. 4 is a side sectional view of the adjustable tuning device of FIG. 1 attached to a barrel in the forward condition with the weight in the forward position.
Figure 5:
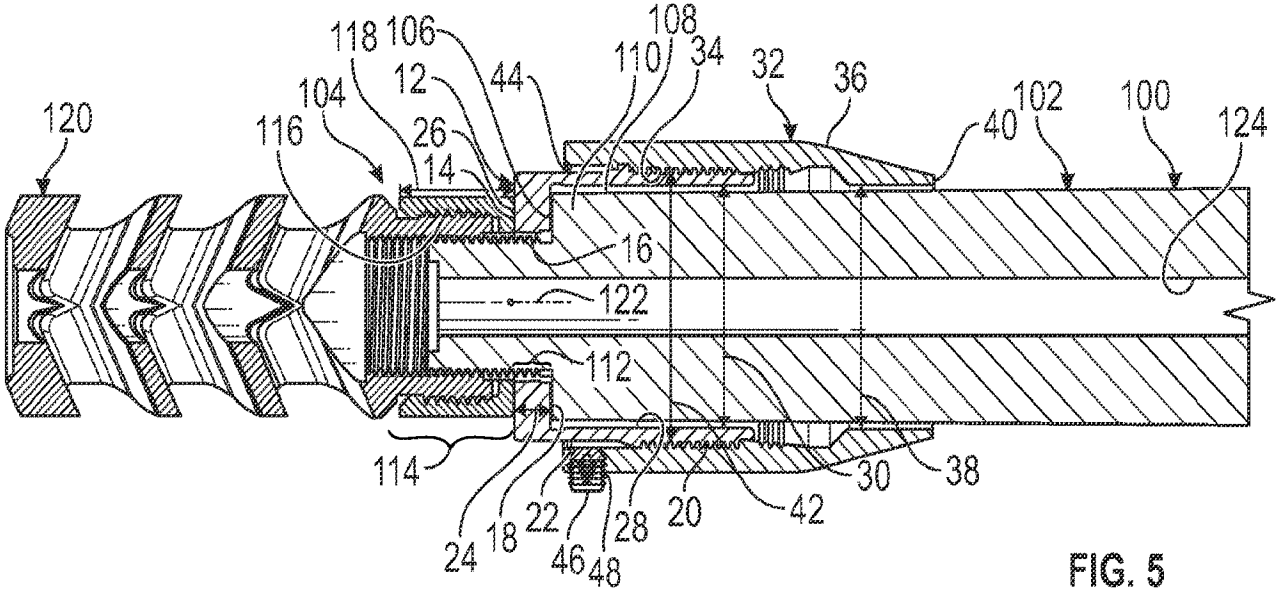
FIG. 5 is a side sectional view of the adjustable tuning device of FIG. 1 attached to a barrel in the forward condition with the weight in the rearward position.
Figure 6:
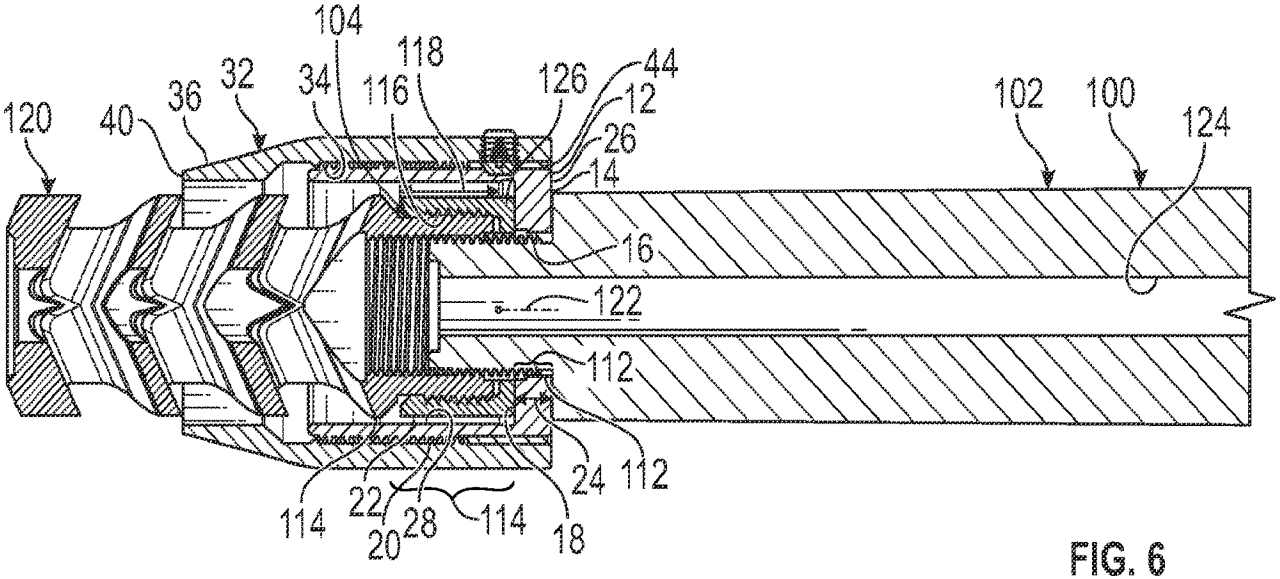
FIG. 6 is a side sectional view of the adjustable tuning device of FIG. 1 attached to a barrel in the reversed condition to accommodate a shorter barrel with the weight in the centered position.

FIGS. 1-6 illustrate the improved adjustable tuning device 10 of the present invention. More particularly, FIGS. 1 and 3-6 shows the adjustable tuning device in use attached to the muzzle portion 104 of the barrel 102 of a gun or firearm 100, which can be an air rifle. FIGS. 1 and 3-5 show the adjustable tuning device in the forward condition used with longer barrels. FIG. 6 shows the adjustable tuning device in the reversed condition used with shorter barrels. The barrel includes a forward-facing shoulder 106 rearward of the muzzle portion and a forward barrel portion 108 rearward of the forward-facing shoulder having an exterior profile 110.

The adjustable tuning device 10 includes a mounting member 12. The mounting member 12 can have a cup-like shape. The mounting member 12 includes a base 14 defining a threaded aperture 16. The threaded aperture is configured to closely receive a limited rear portion 112 of the muzzle portion 104 such that a forward portion 114 of the muzzle portion extends forward of or protrudes from the base. The mounting member 12 has a rear surface 18 configured to abut the forward-facing shoulder 106 of the barrel 102. The mounting member 12 is externally threaded with external threads 20 and has a skirt 22 extending rearwardly of the base. The skirt defines an internal space 28 with a diameter 30 greater than the exterior profile 110 of the barrel, and is externally threaded with the external threads 20. However, when the adjustable tuning device 10 acts as a replacement nut on self-timing muzzle brakes, or is attached to or as the endcap on an airgun barrel shroud, the diameter 30 may not need to be greater than the barrel or barrel shroud diameter. Depending on the characteristics of the host firearm, the mounting member may abut a barrel shroud or shroud endcap instead of the barrel shoulder, particularly in the case where the host weapon is an airgun.

The muzzle portion 104 of the barrel 102 is threaded with muzzle threads 116, and the threaded aperture 16 of the mounting member 12 mates with the muzzle portion. The base 14 of the mounting member 12 has a limited thickness 24 less than half a length 118 of the muzzle portion such that a major portion (the forward portion 114 of the muzzle portion) is exposed to receive and connect to a user-selected muzzle device 120. In the current embodiment, the muzzle device 120 is a muzzle brake, which is a separate muzzle device configured for attachment to the forward portion of the muzzle portion while the mounting member is attached to the limited rear portion 112 of the muzzle portion. The base 14 of the mounting member is compressively captured between the muzzle device and the forward-facing shoulder 106 of the barrel or barrel shroud. The base of the mounting member has a forward-facing surface 26 configured to be abutted by the muzzle device connected to the protruding forward portion of the muzzle portion. In the current embodiment, the limited thickness of the base of the mounting member is less than ¼ inch and less than the diameter of the threaded aperture.

A tuning weight 32 has internal threads 34 configured to mate with the external threads 20 on the skirt 22 of the mounting member 12. The tuning weight is operable to move in a range of axial positions with respect to the mounting member along barrel axis 122 defined by the barrel bore 124 of the barrel 102. In the current embodiment, the tuning weight has a rear tapered portion 36 that tapers to a reduced internal diameter 38 at a rear end 40. The reduced internal diameter accommodates barrels having an exterior profile 110 with a diameter of up to 1.08 inch approximately 2 inch behind the muzzle forward facing shoulder 106. The taper helps maintain a closer fit to the barrel exterior profile to avoid catching the tuning weight on barricades or external objects. However, it should be appreciated that the tuning weight does not typically contact the barrel exterior profile. The mounting member has an external diameter 42 at the external threads 20, and the reduced internal diameter of the tuning weight at the rear tapered portion is less than the external diameter of the mounting member in the depicted embodiment. The tuning weight has an open front end 44 configured to enable attachment of the muzzle device 120 forward of the base 14 of the mounting member to the muzzle threads 116 on the muzzle portion 104 of the barrel. In alternative embodiments, a smaller, non-tapered version of the tuning weight can be used for hunting rifles, and a larger version of the tuning weight can be used for larger barrel profiles and airgun shrouds.

Figure 3:
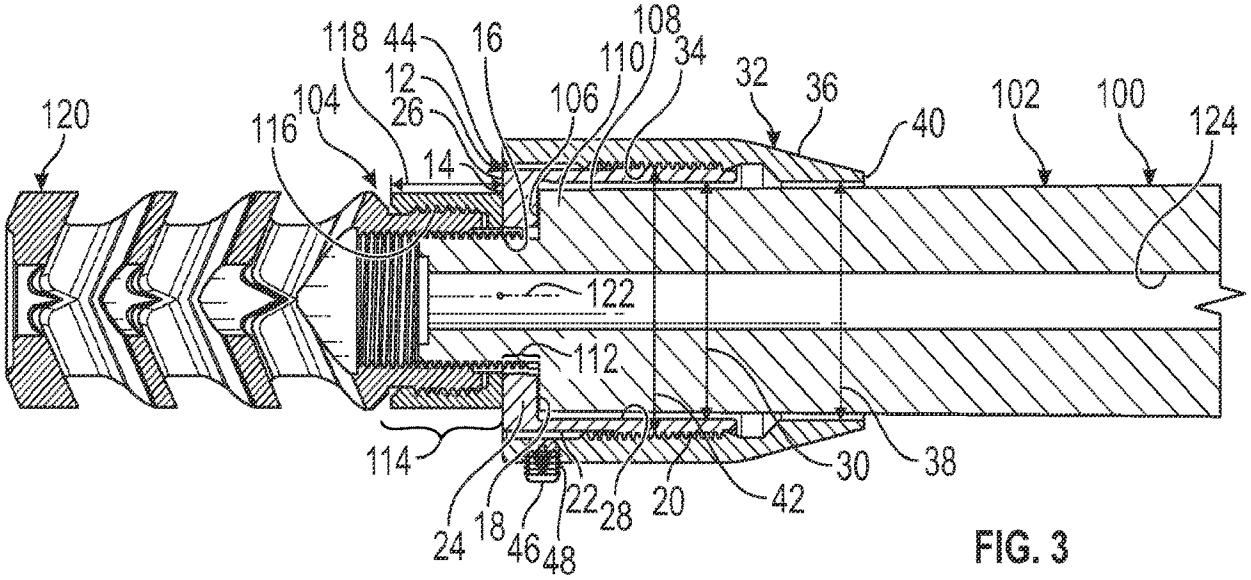
FIG. 3 is a side sectional view of the adjustable tuning device of FIG. 1 attached to a barrel in the forward condition with the weight in the centered position.

FIGS. 3-5 illustrate the improved adjustable tuning device 10 of the present invention. More particularly, FIG. 3 shows the tuning weight 32 in the centered position with respect to the mounting member 12. FIG. 4 shows the tuning weight in the forward position with respect to the mounting member with a portion of the muzzle device 120 received by the open front end 44 of the tuning weight, but not contacted by the tuning weight. FIG. 5 shows the tuning weight in the rearward position with respect to the mounting member. Changes in tuning weight position are accomplished by loosening a set screw 46 received in a threaded aperture 48 in the tuning weight, rotating the tuning weight about the external threads 20 of the skirt 22 until the tuning weight is translated to via the threads to the desired axial position relative to the mounting member, and tightening the set screw against the skirt to prevent undesirable movement of the tuning weight in response to vibrations or recoil and impact forces. Different positions of the tuning weight relative to the mounting member change the characteristics of the barrel when the gun 100 is discharged, and a selected tuning weight position will improve the accuracy of the gun by the mass of the weight tuning the harmonic vibrations of the barrel.

FIG. 6 illustrates the improved adjustable tuning device 10 of the present invention. More particularly, the adjustable tuning device is shown in the reversed condition with the tuning weight 32 in the centered position. In the reversed condition, the selected muzzle device 120 is received by the rear tapered portion 36 of the tuning weight 32, but is not contacted by the weight 32. The open front end 44 of the weight 32 receives the exterior profile 110 of the barrel 102, but does not contact the barrel exterior profile. The reversed condition is used with shorter barrels where moving the tuning weight 32 to the rearward position would be obstructed by the gun stock or chassis (not shown), or with pistols or other weapon designs that do not allow for the tuning weight to extend rearward of the muzzle portion 104.

It should be appreciated that the adjustable tuning device 10 is intended to be used with a selected muzzle device 120 to secure the mounting member 12 against the forward-facing shoulder 106 of the barrel 102. The muzzle device can include, but is not limited to, a thread protector, muzzle brake, or suppressor. The adjustable tuning device can be made of solid or semi-solid materials including rubber, plastic or plastic-like materials, steel, aluminum, and titanium. Finishes for the adjustable tuning device can include any coating type such as bare, painted, cerakote, anodized, and nitride.

It should also be appreciated that the adjustable tuning device is suitable for use with air rifles or other projectile launching devices. The adjustable tuning device can engage existing shroud threads, endcap threads, airstripper threads, muzzle brake threads, and suppressor mount threads in addition to muzzle threads and in alternative configurations may include a set of threads to be used for additional muzzle device attachments. The adjustable tuning device can replace the jam nut used by self-timing muzzle brakes or suppressor mounts, thereby reducing the overall length of the gun while adding the ability to tune the weapon. The adjustable tuning device can be used in conjunction with an air rifle's existing barrel shroud endcap or airstripper, or replace the existing barrel shroud endcap or airstripper, to provide the ability to tune the air rifle. The adjustable tuning device can also act as a barrel tensioning device when used for an air rifle, air rifle shroud, or combination thereof.

Figure 7:
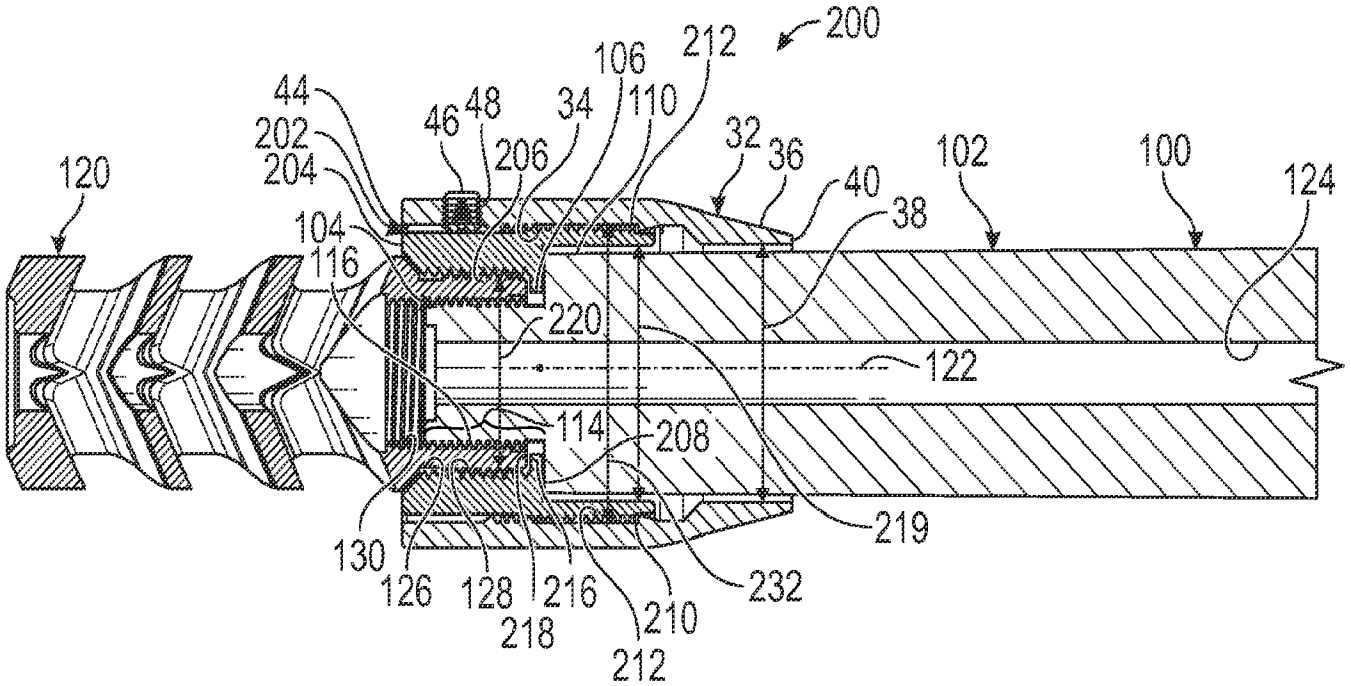
FIG. 7 is a side sectional view of an alternative embodiment of the adjustable tuning device where the mounting member serves as the locking/jam nut for a self-timing muzzle brake.

FIG. 7 illustrates an alternative embodiment of the improved adjustable tuning device 200 of the present invention. More particularly, FIG. 7 shows an alternative embodiment of the adjustable tuning device in use attached to the muzzle portion 104 of the barrel 102 of a gun 100, which is a rifle in the depicted embodiment. This embodiment of the adjustable tuning device 200 has a cup or mounting member 202 having a base 204 defining a threaded aperture 206. The threaded aperture is configured to receive the muzzle portion 104 and a limited rear portion 126 of the muzzle device 120 such that a forward portion 114 of the muzzle portion does not extend forward of the base. Compared to the threaded aperture 16 of the mounting member 12, the threaded aperture 206 of the mounting member 202 is enlarged to match the thread dimensions on the external diameter of a self-timing muzzle brake serving as the muzzle device 120. This change enables the mounting member to replace and act as the reverse jam nut 122 on self-timing muzzle brakes. The mounting member has a rear surface 208 configured to abut the forward-facing shoulder 106 of the barrel 102. The mounting member is externally threaded with external threads 210 and has a skirt 212 extending rearwardly of the base. The skirt defines an internal space 212 with a diameter 214 greater than the exterior profile 110 of the barrel, and is externally threaded with the external threads 210. Depending on the characteristics of the host gun, the mounting member may abut a barrel shroud or shroud endcap instead of the barrel shoulder, particularly in the case where the host gun is an airgun.

The muzzle portion 104 of the barrel 102 is threaded with muzzle threads 116. The threaded aperture 206 of the mounting member 202 mates with a threaded exterior portion 128 of the limited rear portion 126 of the muzzle device 120. The threaded aperture of the mounting member has an internal diameter 220 sized such that the forward portion 114 of the muzzle portion is exposed to receive and connect to the internal threads 130 on the user-selected muzzle device 120. In the current embodiment, the muzzle device is a muzzle brake, which is a separate muzzle device configured for attachment to the forward portion of the muzzle portion while the mounting member is threadingly attached to the limited rear portion 126 of the muzzle device. The mounting member has an optional flange 216 that is compressively captured between the muzzle device and the forward-facing shoulder 106 of the barrel. The flange has a forward-facing surface 218 configured to be abutted by the muzzle device connected to the forward portion of the muzzle portion.

A tuning weight 32 has internal threads 34 configured to mate with the external threads 210 on the skirt 212 of the mounting member 202. The weight is operable to move in a range of axial positions with respect to the mounting member along a barrel axis 122 defined by the barrel bore 124 of the barrel 102. In the depicted embodiment, the tuning weight has a rear tapered portion 36 that tapers to a reduced internal diameter 38 at a rear end 40. The reduced internal diameter accommodates barrels having an exterior profile 110 with a diameter of up to 1.08 inch approximately 2 inch behind the muzzle forward facing shoulder 106. The taper helps maintain a closer fit to the barrel or shroud exterior profile to avoid catching the tuning weight on barricades or external objects. However, it should be appreciated that the weight does not typically contact the barrel exterior profile. The mounting member has an external diameter 232 at the external threads 210, and the reduced internal diameter of the tuning weight at the rear tapered portion is less than the external diameter of the mounting member in the current embodiment. The tuning weight has an open front end 44 configured to enable attachment of the muzzle device 120 to the muzzle threads 116 on the muzzle portion 104 of the barrel and to the threaded aperture 206 on the mounting member. In alternative embodiments, a smaller, non-tapered version of the weight can be used for hunting rifles, and a larger version of the weight can be used for larger barrel profiles and airgun shrouds.

There may or may not be gaps present between a muzzle device 120 that is a self-timing muzzle brake and the mounting member 202 or mounting member 12. If the alignment works out perfectly, gaps would not be present. However, in most cases there would be gaps to time the muzzle brake correctly, and such gaps are shown in FIGS. 3-7. It should also be appreciated that neither mounting member 202 nor mounting member 12 contacts the muzzle portion 104 of the barrel 102.

In the context of the specification, the terms "rear" and "rearward," and "front" and "forward," have the following definitions: "rear" or "rearward" means in a direction going away from the muzzle of the gun toward a shooter while "front" or "forward" means in a direction going towards or beyond the muzzle of the gun away from the shooter.

While a current embodiment of an adjustable tuning device has been described in detail, it should be apparent that modifications and variations thereto are possible, all of which fall within the true spirit and scope of the invention. Although rifles have been disclosed, the adjustable tuning device is also suitable for use with a wide variety of guns and firearms, including those with heavy contoured barrels designed for extended range or high rates of fire applications such as vehicle-mounted fire systems, track-mounted fire systems, ship-mounted fire systems, and airborne systems. Furthermore, the tuning weight disclosed can be replaced with tuning weights of different sizes or densities to provide the user with additional barrel tuning options. The tuning weight can have external markings to indicate rotational and axial movement. In addition, the threaded aperture of the mounting member can be any desired pitch to accommodate the muzzle threads of the host gun and can also be used with a thread adapter to fit muzzle threads having a different pitch. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustable tuning device for a gun, comprising:

a mounting member configured to engage a forward portion of the gun, the mounting member having a threaded exterior circumferential surface;

an externally threaded protrusion to which a muzzle device for the gun is threadably mountable, said externally threaded protrusion protruding forwardly from the mounting member when the mounting member is engaged with the forward portion of the gun; and a tuning weight in which the mounting member is receivable, the tuning weight having a threaded interior circumferential surface configured to mate with the threaded exterior circumferential surface of the mounting member when the mounting member is received in the tuning weight;

wherein rotation of the tuning weight about the mounting member when the mounting member is received in the tuning weight and engaged with the forward portion of the gun translates the tuning weight along an axis defined by a barrel of the gun relative to the mounting member.

2. The device of claim 1, wherein rotation of the tuning weight about the mounting member when the mounting member is received in the tuning weight translates the tuning weight forward or rearward along the threaded exterior circumferential surface of the mounting member.

3. The device of claim 1, wherein the mounting member defines a threaded aperture from which the threaded protrusion protrudes.

4. The device of claim 1, wherein the forward portion of the gun is threaded.

5. The device of claim 1, wherein the threaded protrusion extends through the mounting member.

6. The device of claim 1, wherein the threaded protrusion is a portion of the barrel.

7. The device of claim 1, wherein the threaded protrusion forms a portion of the forward portion of the gun with which the mounting member is engageable.

8. The device of claim 1, wherein the mounting member defines a threaded aperture in which the forward portion of the gun is received when the mounting member is engaged with the forward portion of the gun.

9. The device of claim 1, wherein the mounting member includes a base through which is defined a threaded aperture configured to mate with the threaded protrusion.

10. The device of claim 9, wherein the threaded protrusion extends from a forward-facing shoulder of the gun through the threaded aperture forward of the base such that threads on the threaded protrusion are exposed for threadably mounting the muzzle device to the threaded protrusion.

11. The device of claim 10, wherein:

the base has an axial thickness that is less than half a length of the threaded protrusion; or at least half the length of the threaded protrusion extends forward of the base.

12. The device of claim 1, wherein:

the mounting member includes a base and a skirt extending from the base; and the skirt defines an internal space having a diameter greater than that of an exterior profile of the barrel.

13. The device of claim 1, wherein the mounting member includes a base through which a threaded aperture is defined and a skirt configured to extend rearwardly over an exterior profile of the barrel when the threaded protrusion is received in the threaded aperture.

14. The device of claim 1, wherein:

the mounting member includes a base and a skirt extending from the base;

the skirt defines an internal space in which either the muzzle device or the barrel is receivable when the mounting member is engaged with the forward portion of the gun;

a threaded aperture is defined through the base;

the forward portion of the gun with which the mounting member is engageable is the threaded protrusion;

the threaded protrusion extends through the threaded aperture and forward of the base such that threads on the threaded protrusion are accessible to threadably mount the muzzle device to the threaded protrusion when the mounting member is engaged with the forward portion of the gun.

15. The device of claim 1, wherein the tuning weight has an open front end through which the muzzle device is receivable.

16. The device of claim 1, wherein:

the threaded exterior circumferential surface of the mounting member has an external diameter; and a portion of the tuning weight spaced from the threads of the threaded interior circumferential surface of the tuning weight has an internal diameter that is less than the external diameter of the mounting member.

17. An adjustable tuning device for a gun, comprising:

an externally threaded mounting member defining a threaded central aperture through which a threaded forward portion of the gun is receivable to secure the mounting member to the gun and mount a muzzle device to the threaded forward portion of the gun forward of the mounting member; and an internally threaded tuning weight in which the mounting member is threadably receivable, wherein rotation of the tuning weight about the mounting member when the mounting member is threadably received in the tuning weight translates the tuning weight forward or rearward along an exterior circumferential surface of the mounting member.

18. The device of claim 17, wherein the threaded forward portion protrudes forward from the threaded aperture of the mounting member when the mounting member is secured to the gun.

* * * * *